US007086973B2

(12) United States Patent
Wells et al.

(10) Patent No.: US 7,086,973 B2
(45) Date of Patent: Aug. 8, 2006

(54) BASEBALL BAT

(75) Inventors: James H. Wells, Oolitic, IN (US); Donald A. Mattingly, Evansville, IN (US)

(73) Assignee: Mattingly Hitting Products, LLC, Oolitic, IN (US)

( * ) Notice: Subject to any disclaimer, the term of this patent is extended or adjusted under 35 U.S.C. 154(b) by 0 days.

(21) Appl. No.: 11/000,698

(22) Filed: Dec. 1, 2004

(65) Prior Publication Data

US 2005/0124442 A1 Jun. 9, 2005

Related U.S. Application Data

(60) Provisional application No. 60/527,325, filed on Dec. 5, 2003.

(51) Int. Cl.
*A63B 59/06* (2006.01)

(52) U.S. Cl. ..... 473/564; 473/566

(58) Field of Classification Search ..... 473/300–303, 473/457, 519, 520, 549, 551, 559, 564–567, 473/568

See application file for complete search history.

(56) References Cited

U.S. PATENT DOCUMENTS

| | | | | |
|---|---|---|---|---|
| 400,354 | A | 3/1889 | Morris | |
| 3,104,876 | A | 9/1963 | Salsinger | |
| D197,180 | S | 12/1963 | Salisbury | |
| 3,554,545 | A | 1/1971 | Mann et al. | |
| 4,098,503 | A | 7/1978 | Antone | |
| 4,331,330 | A | 5/1982 | Worst | |
| 4,445,687 | A | 5/1984 | Merritt | |
| 5,088,733 | A | 2/1992 | Barnea et al. | |
| D351,868 | S | 10/1994 | Pendergast | |
| D355,011 | S | 1/1995 | Subnick | |
| 5,460,369 | A | 10/1995 | Baum | |
| 5,482,270 | A | 1/1996 | Smith | |
| 5,551,690 | A * | 9/1996 | Brown | 473/538 |
| 5,839,983 | A | 11/1998 | Kramer | |
| D417,895 | S | 12/1999 | Kim et al. | |
| D426,451 | S | 6/2000 | Rosenbaum | |
| D444,193 | S | 6/2001 | Dodson | |
| 6,723,001 | B1 * | 4/2004 | Ferris | 473/251 |
| 2003/0144089 | A1 | 7/2003 | Ryan | |

FOREIGN PATENT DOCUMENTS

GB 362604 * 12/1931

* cited by examiner

*Primary Examiner*—Mark S. Graham
(74) *Attorney, Agent, or Firm*—Brinks Hofer Gilson & Lione

(57) ABSTRACT

A baseball bat includes a body portion having a target area with a midline extending longitudinally through the target area center and along the bat's entire length to a handle portion having a pair of substantially planar regions spaced from each other and inclined toward the midline by a convergence angle of between about 50° and 70°. The planar regions are separated by curved surface regions joining the planar regions to each other and sloping regions at each longitudinal end of the planar regions. The bat provides enhanced tactile information concerning the dynamic characteristics of the bat during the swing up to and through contact with a pitched ball so that the batter can learn substantially improved location and trajectory control.

20 Claims, 2 Drawing Sheets

BASEBALL BAT

CROSS-REFERENCE TO RELATED APPLICATIONS

This application claims all benefits of U.S. Provisional Application Ser. No. 60/527,325 filed Dec. 5, 2003.

BACKGROUND

1. Technical Field

The present invention relates generally to the game of baseball, and more specifically to practice bats used to improve performance and control by the batter.

2. General Background

Conventional baseball bats are substantially circular in cross section along their entire length. Such bats are thicker at the ball striking or body portion than they are at the handle portion. Such bats are generally tapered between the thicker body portion and the thinner handle portion. The taper can vary in length and can extend along substantially the entire length of the bat. Hitting a pitched baseball with such a bat is generally considered to be an acquired skill that can be taught through good coaching. Hitting a pitched baseball with such a bat to a desired location with a desired trajectory is a skill that can generally only be achieved after much practice even by persons with good athletic capabilities. Good instruction by a capable coach can shorten the process of acquiring such ball destination control skills, but every good coach is looking for all the help they can get in instructing the batters.

Some attempts have been made to develop baseball bats having structural features that are intended to improve the performance of batters that have only modest skills. One example is found in Morris, U.S. Pat. No. 400,354 wherein the bat has a lower handle portion of circular cross section and an intermediate and ball hitting portions of oval cross section to present a larger ball striking-face. The Morris bat has a circular handle portion which gradually merges into an oval form. While such a bat might be initially useful for the novice to acquire the basic skill of having the bat contact the pitched baseball, it is of little use to the more experience player desiring to improve the ball destination control skills. An even more extreme example is found in Salsinger, U.S. Pat. No. 3,104,876 which provides for a body of square cross-section and a round handle including an attached corrugated finger grip. Any non-central contact between a pitched ball and either the square body of the Salsinger bat or even the oval body of the Morris bat would result in a torque being applied to the hands of the batter. While this might be useful to provide immediate feedback of how squarely the pitched ball was hit, it might also stimulate the batter to grip the bat harder to lessen the twisting action of the bat. It is generally thought that an overly firm grip of a baseball bat is undesirable and will not lead to enhanced location and trajectory control skills.

Some bats have been developed that include the traditional body of circular cross-section and handles of special shape. Mann, U.S. Pat. No. 3,554,545 discloses a baseball bat wherein both the body and handle have the traditional circular cross-section, however the handle is angularly offset with respect to a longitudinal axis of the body. It is difficult to see how the handle offset can be usefully employed to enhance the location and trajectory control skills of the emerging athlete. Barnea et al, U.S. Pat. No. 5,088,733 discloses a baseball bat with a body of circular cross-section and a handle that is oval, oblong or elliptical. Such a bat can help naturally align the desired target area of the bat, often called the sweet spot, with the approaching pitched baseball. However, the reduced radius of curvature of the handle portion held between the base of the thumb and palm of the following hand can cause, upon contact with the pitched baseball, enhanced concentration of the impact on the base of the thumb which can be painful, and can inhibit proper follow-through by the batter. Smith, U.S. Pat. No. 5,482,270 and Kramer, U.S. Pat. No. 5,839,983 have suggested the adoption of handgrips for baseball bats that include resilient cushioning features to soften the impact on the base of the thumb of the following hand. These cushioning features significantly isolate the fingertips from contact with the bat such that no meaningful location and trajectory control is possible even by a very skilled player, let alone one still in training.

Thus there remains a need for a bat designed specifically to impart the skills of location and trajectory control, which when mastered can easily be translated by the batter for use with baseball bats of conventional design. There particularly remains a need for a bat designed to impart information concerning each contact with the pitched ball through the finger tips of the batter, thereby enhancing the desirable feedback that leads to increased location and trajectory control by the batter.

BRIEF SUMMARY

A baseball bat according to the present invention includes a body portion having a target area of intended contact with a baseball, often referred to as the "sweet spot". A midline extends longitudinally through the center of the target area and along the bat's entire length. The baseball bat according to the present invention also includes a handle portion that including a pair of substantially planar regions spaced from each other and inclined toward the midline. Each of the planar regions can have substantially parallel edges at least in a central segment of the handle portion. The handle portion can include curved surface regions joining the edges of the planar regions to each other and sloping regions at each longitudinal end of the planar regions.

A baseball bat of the present invention is preferably composed entirely of wood, but can also be composed at least in part of a suitable metal or even a composite material so long as the handle does not involve a resilient cushioning member, which isolates the finger tips of the batter from the planar regions of bat handle so that the sensory input provided is significantly diminished and therefore useless for any training purposes. Examples of composite material bats are to be found in U.S. Pat. Nos. 2,379,006; 2,793,859; 4,572,508; and 5,114,144. The handle portion of a bat of the present invention can include a thin, non-compressible layer for the purpose of enhancing the torque coupling between the bat and the batter's hands. The thin, non-compressible layer can have a tacky surface to further enhance the torque coupling between the bat and the batter's hands. The body portion of a baseball bat of the present invention will generally be cylindrical in cross-section, however, other cross-sectional shapes for the body portion are possible.

The planar regions can be varied in width and length to suit the size of the hands of the batter and the bat. While the planar regions will generally be of equal size, some variation between the planar regions of a single bat are possible, particularly as the batter becomes more skilled and wants to begin the transfer those skills to a bat of conventional configuration. The convergence angle between the planar regions can vary between about 50° and 70° to accommodate variations in grip preference of the batter, however, the preferred convergence angle is about 60°. The two curved surface regions joining the planar regions can be sectors of a common cylindrical surface.

The planar regions of the handle are intended to be contacted by the finger tips of the batter while the curved surface region joining the edges of the planar region provides a large comfortable surface held by the palm of the trailing hand at the base of the thumb for distributing the hitting impact between the bat and ball. The sensory input from the planar regions to the finger tips of the batter provide for enhanced control by the batter leading to substantially improved location and trajectory control.

These and other features and advantages of the present invention will become apparent from a consideration of the following description taken in conjunction with the accompanying drawings.

DESCRIPTION OF THE PREFERRED EMBODIMENTS

Figure 1:
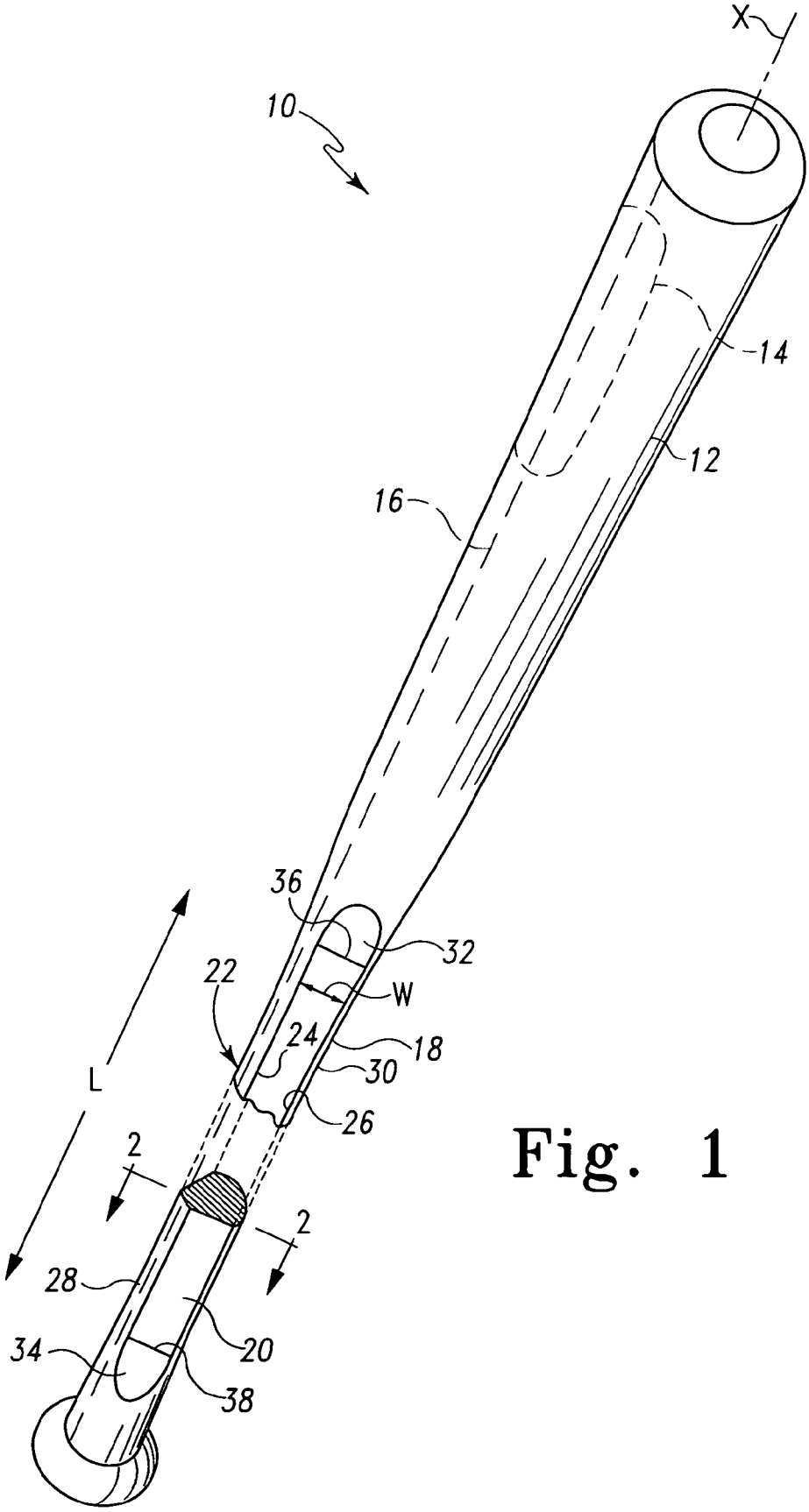
FIG. 1 is a perspective view of a baseball bat of the present invention.

A baseball bat 10 according to the present invention is shown in FIG. 1 to include a body portion 12 that is intended for contact with a pitched baseball. The body portion 12 has a target area 14 of intended contact with a baseball, often referred to as the "sweet spot". A midline 16 extends longitudinally through the center of the target area 14 and along the entire length of the bat 10. It is to be understood that the midline 16 is not actually physically present as an inscribed line of the surface of the bat 10, but merely constitutes a reference line that is useful for relating some of the other geometric features of the bat 10.

A baseball bat 10 according to the present invention also includes a handle portion 18 that includes a pair of substantially planar regions 20 and 22 spaced from each other and inclined toward the midline 16. A clear demarcation between the body portion 12 and the handle portion 18 is often difficult to identify since together the two portions 12 and 18 generally form a single one-piece unitary structure. In some situations, depending on the composition of the bat 10, for example, the bat 10 can be constructed from two or more discrete elements, however any demarcation between such discrete elements is unlikely to be positioned between the body portion 12 and handle portion 18 as such positioning would likely lead to an undesirable zone of weakness in the bat.

As a general rule, the planar regions 20 and 22 are confined to the handle portion 18. Each of the planar regions 20 and 22 has a length L and a width W. The planar regions 20 and 22 generally have substantially parallel edges 24 and 26 at least in a central segment of the handle portion 18, although the edges 24 and 26 can be tapered slightly with respect to each other. The handle portion 18 generally includes curved surface regions 28 and 30 joining the adjacent edges 24 and 26 of the planar regions, respectively, to each other. The handle portion 18 can also include sloping regions 32 and 34 at each longitudinal end 36 and 38 of the planar regions 20 and 22. The planar regions 20 and 22 can be varied in width and length to suit the size of the hands of the batter and the bat 10.

Figure 2:
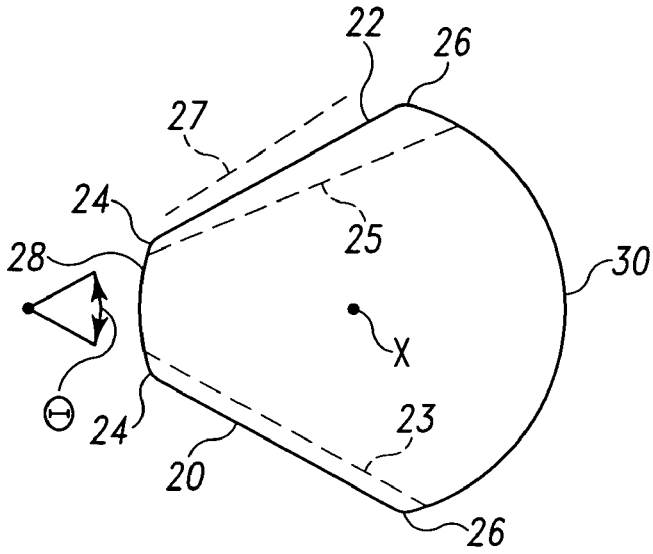
FIG. 2 is a cross-sectional view taken through the handle portion along the line 2—2 of FIG. 1.

As shown in FIG. 2, the curved surface regions 28 and 30 can constitute sectors of a common cylindrical surface centered on the longitudinal axis X of the bat 10. The planar regions 20 and 22 are inclined with respected to each other by an angle θ, herein referred to as the convergence angle. The convergence angle θ between the planar regions 20 and 22 can vary between about 50° and 70° to accommodate variations in grip preference of the batter, however, the preferred convergence angle is about 60°. The variations in convergence angle θ will allow for the angular displacement of the planar regions symbolized by phantom planes 25 and 27. Variation in the width W of the planar regions can be accomplished without changing the convergence angle θ as shown by the phantom plane 23. The edges 24 and 26 of the planar regions 20 and 22 can be provided with a radius to improve the comfort to the batter.

Figure 3:
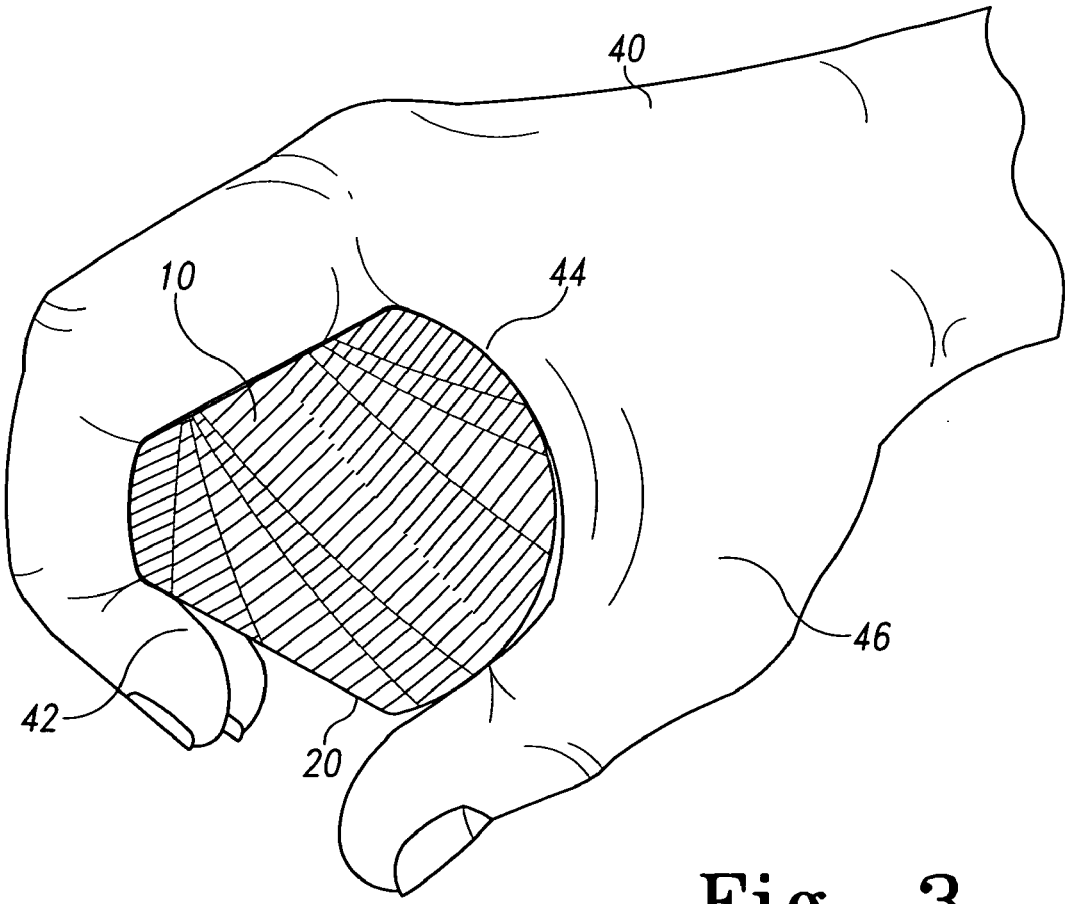
FIG. 3 is a diagrammatic view of the handle portion of the bat shown in FIG. 1 as grasped by the trailing hand of a batter.

FIG. 3 shows a cross-sectional view of a bat 10 of the present invention held in one hand 40 of a batter. The planar regions 20 and 22 of the handle portion 18 are intended to be contacted by the finger tips 42 of the batter. While only one hand of the batter is shown in FIG. 3, it will be appreciated that one of the planar regions 20 or 22 will be contacted by the finger tips of one hand while the other of the planar regions will be contacted by the finger tips of the other hand. The curved surface region 30 joining the edges 26 of the planar regions 20 and 22 provides a large comfortable surface held by the palm 44 of the hand at the base of the thumb 46 for distributing the hitting impact between the bat 10 and a ball, not shown. The planar regions 20 and 22 provide sensory input to the finger tips 42 of the batter. The sensory input to the finger tips 42 of the batter by the planar regions 20 and 22 provides enhanced tactile information concerning the various dynamic characteristics of the bat during the swing up to and through contact with a pitched ball so that the batter can learn substantially improved location and trajectory control.

The foregoing detailed description should be regarded as illustrative rather than limiting, and the following claims, including all equivalents, are intended to define the spirit and scope of this invention.

The invention claimed is:

1. A baseball bat comprising:

a body portion including a target area of intended contact with a baseball, the target area having a midline that extends longitudinally along the bat, and a handle portion including a pair of substantially planar regions spaced from each other and inclined toward the midline, each planar region having substantially parallel edges in a central segment of the handle portion, the handle portion including curved surface regions joining the edges of the planar regions to each other, the curved surface regions comprising sectors of a common cylindrical surface, and inclined regions at each longitudinal end of the planar regions.

2. The baseball bat of claim 1 wherein the body portion is substantially cylindrical.

3. The baseball bat of claim 1 wherein the width of each of the pair of substantially planar regions is identical.

4. The baseball bat of claim 1 wherein the length of each of the pair of substantially planar regions is identical.

5. The baseball bat of claim 1 wherein the planar regions define an included angle of between about 50° and 70°.

6. The baseball bat of claim 5 wherein the planar regions define an included angle of about 60°.

7. The baseball bat of claim 1 wherein the bat is entirely composed of wood.

8. The baseball bat of claim 1 wherein a portion of the bat is composed of metal.

9. The baseball bat of claim 1 wherein the bat is composed entirely of a molded composite.

10. A baseball bat comprising:

a substantially cylindrical body portion including a target area of intended contact with a baseball, the target area having a midline that extends longitudinally along the bat, and a handle portion including a pair of substantially planar regions spaced from each other and inclined toward the midline, the planar regions defining an included angle of between about 50° and 70°, each planar region having substantially parallel edges in a central segment of the handle portion, the handle portion including curved surface regions joining the edges of the planar regions to each other and inclined regions at each longitudinal end of the planar regions, the curved surface regions comprising sectors of a common cylindrical surface.

11. The baseball bat of claim 10 wherein the width of each of the pair of substantially planar regions is identical.

12. The baseball bat of claim 10 wherein the length of each of the pair of substantially planar regions is identical.

13. The baseball bat of claim 10 wherein the planar regions define an included angle of about 60°.

14. The baseball bat of claim 10 wherein the bat is entirely composed of wood.

15. The baseball bat of claim 10 wherein a portion of the bat is composed of metal.

16. The baseball bat of claim 10 wherein the bat is composed entirely of a molded composite.

17. A baseball bat comprising:

a substantially cylindrical body portion including a target area of intended contact with a baseball, the target area having a midline that extends longitudinally along the bat, and a handle portion including a pair of substantially planar regions of substantially equal length and width, the regions being spaced from each other and inclined toward the midline, the regions defining an included angle of between about 50° and 70°, each planar region having substantially parallel edges in a central segment of the handle portion, the handle portion including curved surface regions of a common cylindrical surface joining the edges of the planar regions to each other, and inclined regions at each longitudinal end of the planar regions.

18. The baseball bat of claim 17 further comprising a thin, non-compressible layer of material surrounding the handle portion having a outward facing tacky surface.

19. The baseball bat of claim 17 wherein the bat is entirely composed of wood.

20. The baseball bat of claim 17 wherein a portion of the bat is composed of metal.

* * * * *

UNITED STATES PATENT AND TRADEMARK OFFICE

CERTIFICATE OF CORRECTION

PATENT NO. : 7,086,973 B2
APPLICATION NO. : 11/000698
DATED : August 8, 2006
INVENTOR(S) : James H. Wells et al.

It is certified that error appears in the above-identified patent and that said Letters Patent is hereby corrected as shown below:

Column 6
Line 23, delete “a outward” and insert --an outward--.

Signed and Sealed this

Twenty-seventh Day of May, 2008

JON W. DUDAS
*Director of the United States Patent and Trademark Office*